US011174589B2

(12) United States Patent
Javit

(10) Patent No.: US 11,174,589 B2
(45) Date of Patent: Nov. 16, 2021

(54) CLOTHES STEAMER HEAD

(71) Applicant: SEB S.A., Ecully (FR)

(72) Inventor: Maxime Javit, Lyons (FR)

(73) Assignee: SEB S.A.

( * ) Notice: Subject to any disclaimer, the term of this patent is extended or adjusted under 35 U.S.C. 154(b) by 8 days.

(21) Appl. No.: 16/347,066

(22) PCT Filed: Oct. 26, 2017

(86) PCT No.: PCT/FR2017/052958
§ 371 (c)(1),
(2) Date: May 2, 2019

(87) PCT Pub. No.: WO2018/083401
PCT Pub. Date: May 11, 2018

(65) Prior Publication Data

US 2020/0071874 A1 Mar. 5, 2020

(30) Foreign Application Priority Data

Nov. 4, 2016 (FR) ..... 1660711

(51) Int. Cl.

| | |
|---|---|
| ***D06F 58/26*** | (2006.01) |
| ***D06F 73/00*** | (2006.01) |
| ***D06F 75/12*** | (2006.01) |
| ***D06F 75/20*** | (2006.01) |
| ***D06F 75/24*** | (2006.01) |
| ***D06F 87/00*** | (2006.01) |

(52) U.S. Cl.
CPC ..... *D06F 73/00* (2013.01); *D06F 58/26* (2013.01); *D06F 75/12* (2013.01); *D06F 75/20* (2013.01); *D06F 75/24* (2013.01); *D06F 87/00* (2013.01)

(58) Field of Classification Search
CPC ..... D06F 58/26; D06F 73/00; D06F 75/12; D06F 75/20; D06F 75/24; D06F 87/00
USPC ..... 38/14, 15, 77.9; 68/5 A
See application file for complete search history.

(56) References Cited

U.S. PATENT DOCUMENTS

2014/0373402 A1 12/2014 Zhang et al.

FOREIGN PATENT DOCUMENTS

EP 2 336 421 A1 6/2011
WO WO 2014/177964 A1 11/2014

OTHER PUBLICATIONS

International Search Report as issued in International Patent Application No. PCT/FR2017/052958, dated Jan. 18, 2018.

*Primary Examiner* — Levon J Shahinian
(74) *Attorney, Agent, or Firm* — Lerner, David, Littenberg, Krumholz & Mentlik, LLP

(57) ABSTRACT

This steamer head includes a body enclosing a steam distribution circuit and an air distribution circuit which are separated by a dividing partition, the steam distribution circuit including at least one steam inlet orifice intended to be connected to a steam generator and at least one steam outlet for diffusing a stream of steam, the air distribution circuit including a blower, an air inlet orifice and an air outlet for diffusing a stream of air, the at least one steam outlet and the air outlet being arranged at the one same end of the body of the steamer head. The steamer head includes a shut-off member that can be moved between a shut-off position in which the shut-off member closes off the air outlet and an open position in which the shut-off member uncovers the air outlet.

19 Claims, 4 Drawing Sheets

Fig. 1
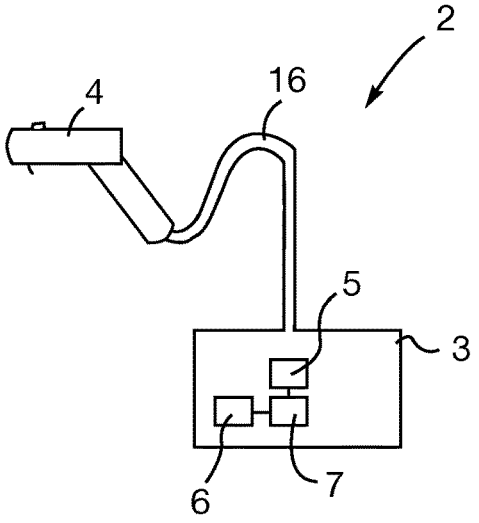
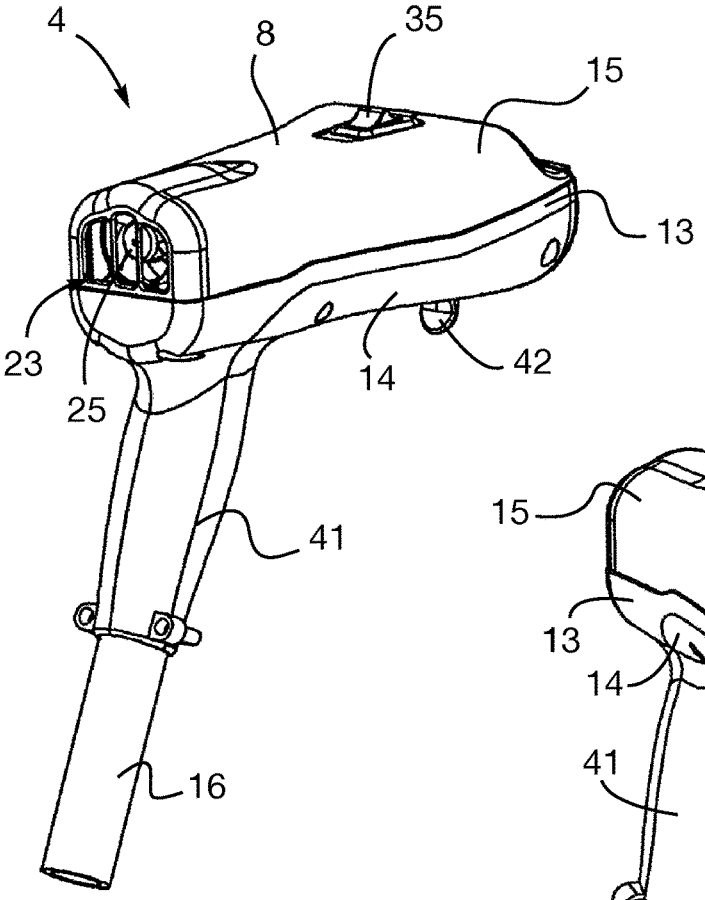
Fig. 2
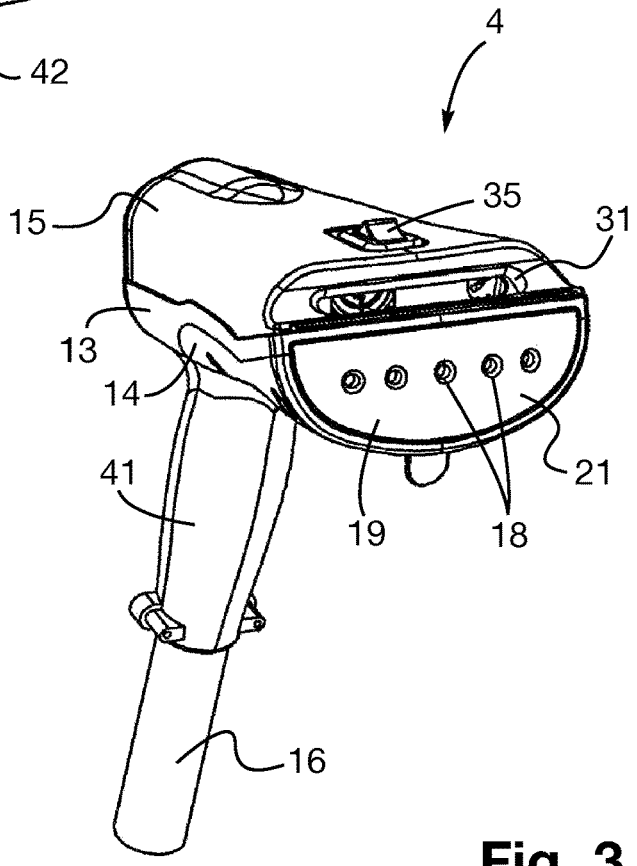
Fig. 3

Fig. 7
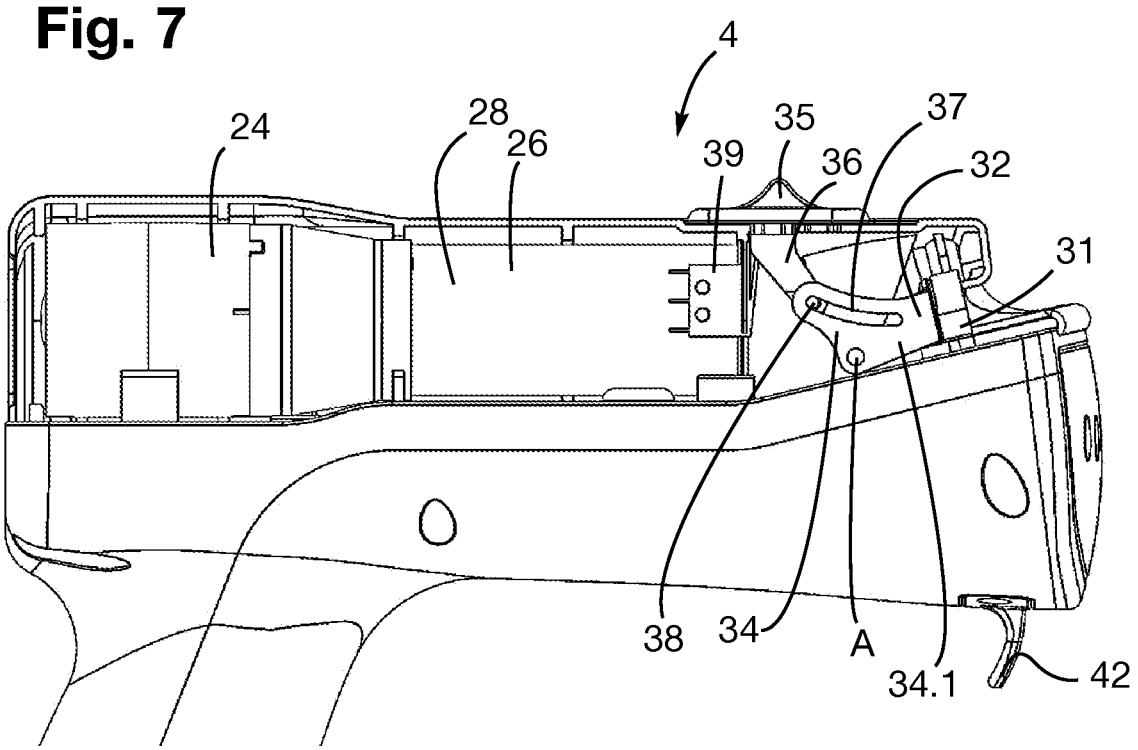
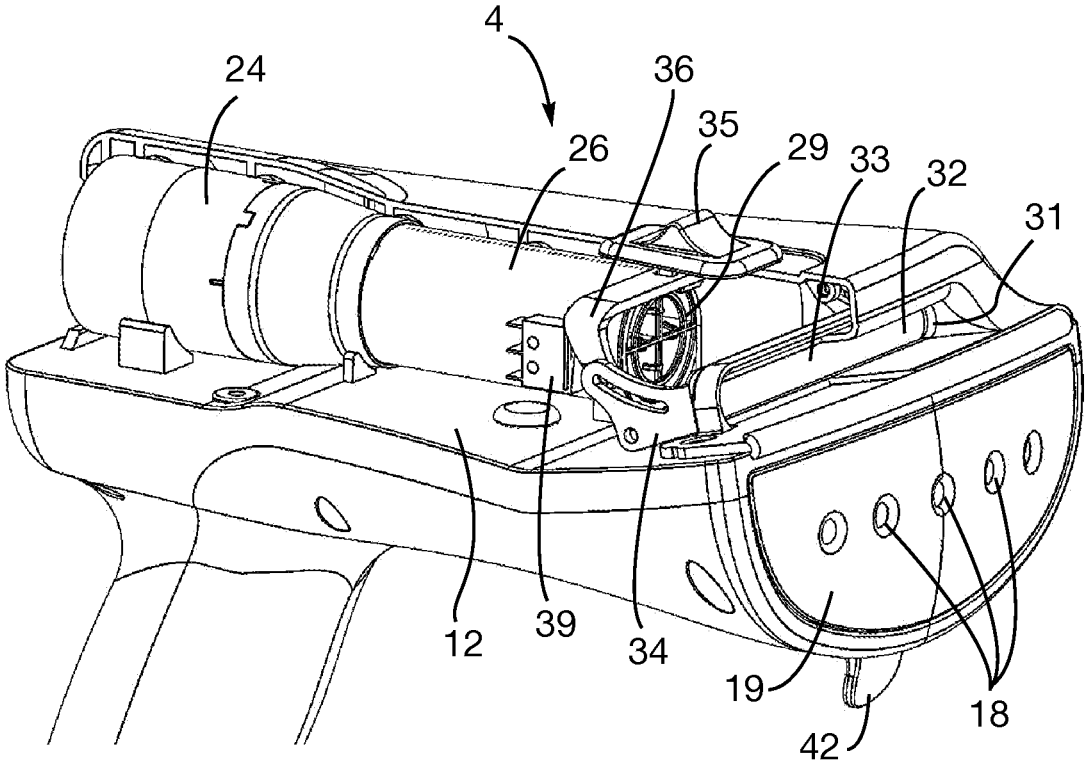
Fig. 8

CLOTHES STEAMER HEAD

CROSS REFERENCE TO RELATED APPLICATIONS

This application is the U.S. National Stage of PCT/FR2017/052958, filed Oct. 26, 2017, which in turn claims priority to French Patent Application No. 1660711 filed Nov. 4, 2016, the entire contents of all applications are incorporated herein by reference in their entireties.

This invention concerns a smoothing head, and more particularly a steam smoothing head.

The document EP2336421 describes a steamer head comprising a body enclosing a steam distribution circuit and an air distribution circuit separated from one another, the steam distribution circuit comprising at least one steam inlet orifice intended to be connected to a steam generator and at least one steam outlet for diffusing a stream of steam, the air distribution circuit comprising a blower, an air inlet orifice and an air outlet for diffusing a stream of air, the at least one steam outlet and the air outlet being arranged at the same end of the body of the steamer head.

Such a steamer head makes it possible, by means of the steam distribution circuit, to diffuse a stream of steam on a fabric to be smoothed, and thus to very quickly smooth curtains or garments hung vertically on a hanger, for example.

In addition, such a steamer head, by means of the air distribution circuit, makes it possible to diffuse a stream of air on a fabric smoothed with steam, and thus to very quickly dry curtains or garments previously smoothed with the steamer head. These provisions thus make it possible to put clothes away very quickly after smoothing them, or to put them on just as quickly after smoothing them with steam. In addition, quickly removing steam and moisture from a garment after having smoothed it makes it possible to preserve a longer-lasting smoothing result.

However, the use of an air distribution circuit that can be activated or not activated at the user's request may potentially be dangerous when steam is present. In fact, when the steam diffusion circuit is operating, steam may enter the air diffusion circuit and condense on the components of the air diffusion circuit, which may be harmful during a subsequent use of the air diffusion circuit. This invention aims to remedy this disadvantage.

The technical problem at the basis of the invention thus consists of providing a steamer head with a simple and economical structure, while ensuring safe use of the steamer head.

For this purpose, this invention concerns a steamer head comprising a body enclosing a steam distribution circuit and an air distribution circuit separated from one another, the steam distribution circuit comprising at least one steam inlet orifice intended to be connected to a steam generator and at least one steam outlet for diffusing a stream of steam, the air distribution circuit comprising a blower, an air inlet orifice and an air outlet for diffusing a stream of air, the at least one steam outlet and the air outlet being arranged at the same end of the body of the steamer head, characterized in that the steamer head comprises a shut-off member that can be moved between a shut-off position in which the shut-off member closes off the air outlet and an open position in which the shut-off member uncovers the air outlet.

The presence of such a shut-off member makes it possible to close the air outlet when the air diffusion circuit is not activated, and thus to avoid the penetration and condensation of steam in the air diffusion circuit when the steam diffusion circuit is activated. Thus, such a shut-off member makes the steamer head safe to use.

The steamer head may in addition have one or more of the following characteristics, taken alone or in combination.

According to one embodiment of the invention, the shut-off member is configured to close off the air outlet in a steam-proof manner when the shut-off member is in the shut-off position.

According to one embodiment of the invention, the steamer head further comprises a control system configured to cut the power supply to the blower when the air outlet is closed off by the shut-off member.

In other words, the control system is configured to cut the power supply to the blower when the shut-off member is moved into the shut-off position, that is, when the shut-off member reaches the shut-off position or shortly after it has reached it. These provisions make it possible to stop the blower and thus the diffusion of the stream of air only if the shut-off member properly closes off the air outlet, and thus to avoid any risk of steam penetration in the air diffusion circuit via the air outlet when the user chooses not to use the steamer head's drying function.

According to one embodiment of the invention, the control system is configured to control the power supply to the blower when the shut-off member is moved from the shut-off position toward the uncovering position.

According to one embodiment of the invention, the control system comprises a switch that can be actuated by a movement of the shut-off member, the switch being configured to cut the power supply to the blower when the air outlet is closed off by the shut-off member.

According to one embodiment of the invention, the switch is configured to control the power supply to the blower when the shut-off member is moved from the shut-off position toward the uncovering position.

According to one embodiment of the invention, the switch may be a lever switch or a limit switch, and may be a microswitch, for example.

According to one embodiment of the invention, the control system comprises a control button mounted such that it can move on the body of the steamer head between an operating position and an off position, and the steamer head being configured such that a movement of the control button from the operating position to the off position causes the shut-off member to move from the open position to the shut-off position, and such that a movement of the control button from the off position to the operating position causes the shut-off member to move from the shut-off position to the open position.

According to one embodiment of the invention, the control button is connected, directly or indirectly, to the shut-off member.

According to one embodiment of the invention, the steamer head comprises a connecting device connecting the control button and the shut-off member, the connecting device being configured such that a movement of the control button from the operating position to the off position causes the shut-off member to move from the open position to the shut-off position, and such that a movement of the control button from the off position to the operating position causes the shut-off member to move from the shut-off position to the open position.

According to one embodiment of the invention, the control button is mounted such that it can slide on the body of the steamer head between the operating and off positions.

According to one embodiment of the invention, the connecting device comprises a connecting member connected to the control button in order to move therewith. The connecting device is advantageously housed in the body.

According to one embodiment of the invention, the shut-off member is housed at least partially in the body.

According to one embodiment of the invention, the shut-off member comprises a shut-off part configured to close off the air outlet, and an actuating part connected, directly or indirectly, to the control button, and for example connected to the connecting device.

According to one embodiment of the invention, the actuating part comprises two substantially parallel lateral flanges fixed to the shut-off part.

According to one embodiment of the invention, the connecting member is in the general shape of a "U" and has a central section fixed to the control button and two lateral connecting branches connected to the shut-off member.

Advantageously, each lateral connecting branch is connected to a respective lateral flange of the actuating part.

According to one embodiment of the invention, the switch is configured to be actuated by the connecting device, and for example by the connecting member, when the shut-off member is moved between the shut-off position and the open position.

According to one embodiment of the invention, the switch is configured to be actuated by the shut-off member, by the actuating part, for example, when the shut-off member is moved between the shut-off position and the open position.

According to one embodiment of the invention, the air outlet is oblong.

According to one embodiment of the invention, the steamer head comprises a gasket extending around the air outlet and configured to cooperate with the shut-off member when the shut-off member is in the shut-off position.

According to one embodiment of the invention, the air distribution circuit comprises a heating device configured to heat the stream of air generated by the blower. These provisions make it possible to generate a stream of hot air, and thus to improve the drying of a fabric smoothed with the steam diffused by the steamer head.

According to one embodiment of the invention, the heating device comprises a resistive heating element.

According to one embodiment of the invention, the heating device comprises a support on which is arranged, and, for example, wound, the resistive heating element.

According to one embodiment of the invention, the support is elongated and has a cross section in the shape of a cross. The support is advantageously made of insulating material, and for example of Samicanite® (registered trademark).

According to one embodiment of the invention, the heating device further comprises a tubular guide wall extending around the support and configured to guide the stream of air along the support. The tubular guide wall is advantageously made of insulating material, and for example may be formed of a sheet of Samicanite® (registered trademark).

According to one embodiment of the invention, the blower comprises a propeller and an electrical motor configured to drive the propeller in rotation.

According to one embodiment of the invention, the steamer head comprises a nozzle in which the blower is at least partially housed.

According to one embodiment of the invention, the heating device is attached to one end of the nozzle.

According to one embodiment of the invention, the tubular guide wall extends in line with the nozzle and is fluidically connected to an air outlet opening of the nozzle.

According to one embodiment of the invention, the steamer head comprises an air outlet grille arranged at one end of the tubular guide wall which is opposite the blower.

According to one embodiment of the invention, the control system is configured to cut the power supply to the heating device when the air outlet is closed off by the shut-off member.

According to one embodiment of the invention, the control system is configured to control the power supply to the heating device when the shut-off member is moved from the shut-off position toward the uncovering position.

According to one embodiment of the invention, the air inlet orifice and the air outlet are arranged at two opposite ends of the body of the steamer head.

According to one embodiment of the invention, the shut-off member is mounted such that it can pivot between the shut-off position and the open position.

According to one embodiment of the invention, the shut-off member is mounted such that it can pivot around a joint pin that extends transversally to the direction of movement of the control button.

According to one embodiment of the invention, the actuating part is mounted such that it can pivot around the joint pin.

According to one embodiment of the invention, the shut-off member comprises at least one semi-circular actuating slot, and the connecting device comprises at least one actuating element configured to cooperate with the at least one semi-circular actuating slot such that a movement of the control button between the operating position and the off position causes the shut-off member to pivot between the open position and the shut-off position.

According to one embodiment of the invention, each lateral flange of the actuating part comprises a semi-circular actuating slot.

According to one embodiment of the invention, the shut-off member is mounted such that it can move in translation between the shut-off position and the open position.

According to one embodiment of the invention, the shut-off member is a removable plug.

According to one embodiment of the invention, the steamer head further comprises a gripping section. These arrangements facilitate gripping of the steamer head by a user.

According to one embodiment of the invention, the steamer head comprises a hanging element configured to allow the steamer head to hang on a support.

According to one embodiment of the invention, the steamer head comprises a steam diffusion soleplate on which the at least one steam outlet is arranged.

According to one embodiment of the invention, the steam distribution circuit comprises a plurality of steam outlets which may, for example, be aligned.

According to one embodiment of the invention, the steam distribution circuit comprises a steam diffusion chamber integrated in the body of the steamer head.

Advantageously, the steam diffusion chamber is fluidically connected to the at least one air outlet, and is, for example, joined to the steam diffusion soleplate.

Advantageously, a gasket is interposed between the steam diffusion chamber and the steam diffusion soleplate.

According to one embodiment of the invention, the steamer head comprises a steam delivery conduit, which may be flexible, for example, intended to be supplied with steam by the steam generator.

Advantageously, the steam delivery conduit is fluidically connected to the steam diffusion chamber.

According to one embodiment of the invention, the steamer head comprises an adhering element extending close to the steam diffusion soleplate.

Advantageously, the friction element is elongated and elastically deformable.

According to one embodiment of the invention, the body of the steamer head comprises a first protective cover enclosing at least partially the steam distribution circuit, and a second protective cover enclosing at least partially the air distribution circuit.

According to one embodiment of the invention, the body comprises a dividing partition separating the steam distribution circuit and the air distribution circuit from one another.

According to one embodiment of the invention, the body of the steamer head comprises a support shell comprising the dividing partition.

Advantageously, the first and second protective covers are attached to the support shell, such as by screwing.

According to one embodiment of the invention, the hanging element is arranged on one of the first and second protective covers.

According to one embodiment of the invention, the control button is arranged on one of the first and second protective covers.

According to one embodiment of the invention, the steamer head comprises at least one biasing member, such as a helical spring, configured to bias the shut-off member toward the shut-off position.

According to one embodiment of the invention, the steamer head comprises at least one guiding element configured to guide the shut-off member when it is moved between the shut-off position and the open position.

This invention also concerns an apparatus comprising a base unit provided with a steam generator, and a steamer head according to the invention.

The invention will be more fully understood with the assistance of the following description in reference to the attached schematic drawings representing, as non-restrictive examples, two forms of execution of this steamer head.

FIG. 1 is a schematic view of a steam apparatus according to this invention comprising a steamer head according to a first embodiment of the invention and a base unit provided with a steam generator.

FIGS. 2 and 3 are rear and front perspective views of the steamer head in FIG. 1.

FIG. 7 is a side view, partially in cross section, of the steamer head in FIG. 1, showing a shut-off member in the shut-off position.

FIG. 8 is a partial perspective view, partially in cross section, of the steamer head in FIG. 1, showing the shut-off member in the shut-off position.

Figure 4:
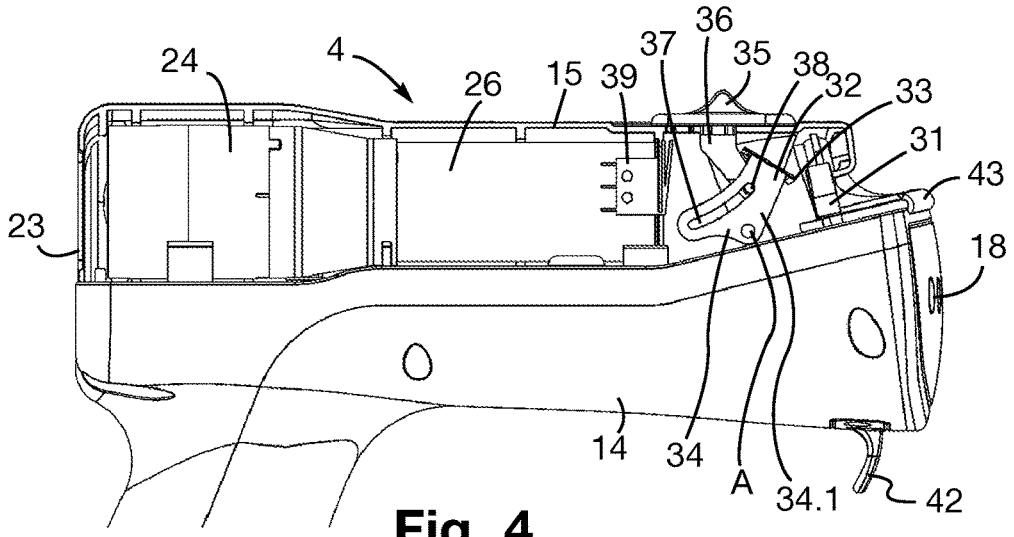
FIG. 4 is a side view, partially in cross section, of the steamer head in FIG. 1, showing a shut-off member in the open position.
Figure 5:
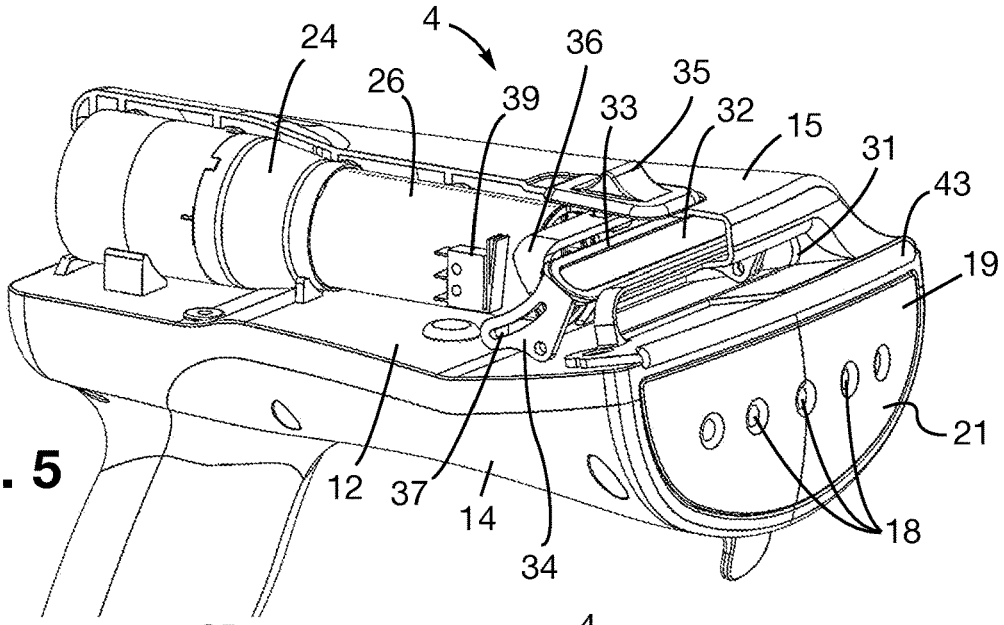
FIG. 5 is a partial perspective view, partially in cross section, of the steamer head in FIG. 1, showing the shut-off member in the open position.

FIGS. 1 to 8 represent a steam smoothing apparatus 2 comprising a base unit 3 and a steamer head 4 according to a first embodiment of the invention. The base unit 3 comprises in particular a steam generator 5 and a water reservoir 6 configured to supply the steam generator 5 with water. The base unit 3 could possibly comprise a pump 7 configured to supply the steam generator 5 with water from the water reservoir 6. However, such a pump is optional.

Figure 6:
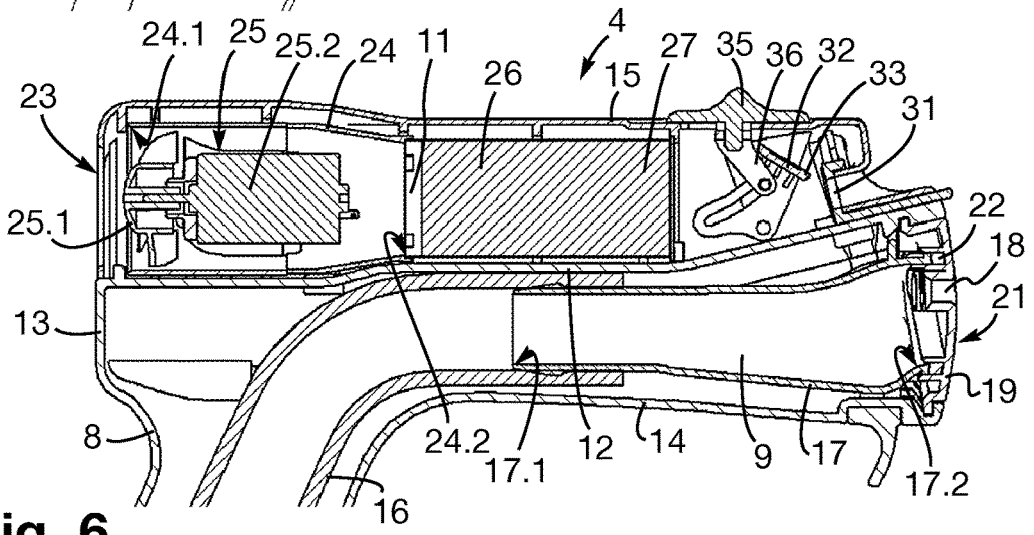
FIG. 6 is a partial longitudinal cross-sectional view of the steamer head in FIG. 1, showing the shut-off member in the open position.

As shown in FIG. 6, the steamer head 4 comprises a body 8 enclosing a steam distribution circuit 9 and an air distribution circuit 11, and comprising a dividing partition 12 separating the steam distribution circuit 9 and the air distribution circuit 11 from one another. The body 8 comprises more particularly a support shell 13 comprising the dividing partition 12, and a first protective cover 14 and a second protective cover 15 attached to the support shell 13, such as by screwing.

According to the embodiment represented in FIGS. 1 to 8, the first protective cover 14 partially encloses the steam distribution circuit 9, and the second protective cover 15 partially encloses the air distribution circuit 11. However, according to an embodiment variant, the first protective cover 14 could partially enclose the air distribution circuit 11, and the second protective cover 15 could partially enclose the steam distribution circuit 9.

As shown more particularly in FIGS. 4 to 8, the steam distribution circuit 9 comprises a steam delivery conduit 16 fluidically connected to the steam generator 5 and extending at least partially into the body 8, and a steam diffusion chamber 17 integrated in the body 8 and intended to be supplied with steam by the steam delivery conduit 16. The steam diffusion chamber 17 comprises more particularly a steam inlet orifice 17.1 fluidically connected to the steam delivery conduit 16, and an outlet orifice 17.2 opposite the steam inlet orifice 17.1.

According to the embodiment represented in FIGS. 1 to 8, the steam distribution circuit 9 further comprises a plurality of steam outlets 18 fluidically connected to the outlet orifice 17.2 of the diffusion chamber 17, and configured to diffuse a stream of steam. However, the steam distribution circuit 9 could comprise a single steam outlet 18.

Advantageously, the steam outlets 18 are aligned and are arranged on a steam diffusion soleplate 19 comprising a contact surface 21 to which the steam outlets 18 discharge.

According to the embodiment represented in FIGS. 1 to 8, the steam diffusion chamber 17 is joined to the steam diffusion soleplate 19 with interposition of a gasket 22.

As shown more particularly in FIG. 6, the air distribution circuit 11 comprises an air inlet orifice 23 arranged opposite the steam outlets 18, a nozzle 24 comprising an inlet opening 24.1 fluidically connected to the air inlet orifice 23 and an outlet opening 24.2 opposite the inlet opening 24.1, and a blower 25 arranged in the nozzle 24. The blower 25 comprises a propeller 25.1 situated next to the air inlet orifice 23 and an electric motor 25.2 configured to drive the propeller 25.1 in rotation.

The air distribution circuit 11 further comprises a heating device 26 attached to one end of the nozzle 24 and configured to heat the stream of air generated by the blower 25. The heating device 26 may comprise a resistive heating element (not represented in the figures) and a support 27 on which is arranged, and, for example, wound, the resistive heating element. The support 27 is advantageously made of insulating material, and may, for example, be made of Samicanite® (registered trademark).

According to the embodiment represented in FIGS. 1 to 8, the support 27 is elongated and has a cross section in the shape of a cross, and the heating device 26 further comprises a tubular guide wall 28 extending around the support 27 and in line with the nozzle 24 so as to guide the stream of air along the support 27. The tubular guide wall 28 is advantageously made of insulating material, and for example may be formed of a sheet of Samicanite® (registered trademark).

The air distribution circuit 11 also comprises an air outlet grille 29 arranged at the end of the tubular guide wall 28 which is opposite the nozzle 24.

Advantageously, the air outlet grille 29 can be configured to cooperate with a stop provided on the support shell 13 and/or a stop provided on the second protective cover 15 in order to keep the heating device 26 and the nozzle 24 in position, and thus to avoid the translation of the latter toward the front of the steamer head 4.

The air distribution circuit 11 further comprises an air outlet 31 configured to diffuse the stream of air.

Advantageously, the steam outlets 18 and the air outlet 31 are arranged at the same end of the body 8 of the steamer head 4, and advantageously opposite the air inlet orifice 23.

According to the embodiment represented in FIGS. 1 to 8, the air outlet 31 is oblong and extends substantially parallel to the direction of alignment of the steam outlets 18.

The steamer head 4 also comprises a shut-off member 32 housed in the body 8 and able to be moved between a shut-off position (see FIGS. 7 and 8) in which the shut-off member 32 closes off the air outlet 31 in a steam-proof manner, and an open position (see FIGS. 4 to 6) in which the shut-off member 32 uncovers the air outlet 31.

Advantageously, the steamer head 4 comprises a gasket extending around the air outlet 31, and the shut-off member 32 is configured to cooperate with the gasket when the shut-off member 32 is in the shut-off position.

According to the embodiment represented in FIGS. 1 to 8, the shut-off member 32 comprises a shut-off part 33 configured to close off the air outlet 31, and an actuating part 34 connected to the shut-off part 33 and mounted such that it can pivot around a joint pin A. The actuating part 34 comprises, for example, two substantially parallel lateral flanges 34.1 that each extend from a respective end of the shut-off part 33.

The steamer head 4 further comprises a control system configured to control the electrical power supply of the heating device 26 and of the blower 25 depending on the position of the shut-off member 32. More particularly, the control system is configured to cut the power supply to the blower 25 and to the heating device 26 when the air outlet 31 is closed off by the shut-off member 32, and to supply electrical power to the blower 25 and to the heating device 26 when the air outlet 31 is at least partially uncovered by the shut-off member 32.

The control system comprises a control button 35 mounted such that it can move, for example by sliding, on the body 8 of the steamer head 4, for example on the second protective cover 15, between an operating position (see FIGS. 4 to 6) and an off position (see FIGS. 7 and 8).

According to the embodiment represented in FIGS. 1 to 8, the control system comprises a connecting device housed in the body 8 and connecting the control button 35 and the shut-off member 32. The connecting device is more particularly configured such that a movement of the control button 35 from the operating position to the off position causes the shut-off member 32 to move from the open position to the shut-off position, and such that a movement of the control button 35 from the off position to the operating position causes the shut-off member 32 to move from the shut-off position to the open position.

The connecting device comprises a connecting member 36 connected to the control button 35 in order to move therewith. The connecting member 36 may, for example, be in the general shape of a "U" and have a central section attached to the control button 35 and two lateral connecting branches connected respectively to the two lateral flanges 34.1 of the actuating part 34.

According to the embodiment represented in FIGS. 1 to 8, each lateral flange 34.1 of the actuating part 34 comprises a semi-circular actuating slot 37, and the connecting device further comprises at least one actuating element 38, such as an actuating spindle or an actuating pin, configured to cooperate with a respective semi-circular actuating slot 37 or with the two semi-circular actuating slots 37, such that a movement of the control button 35 between the operating position and the off position causes the shut-off member 32 to pivot around the joint pin A and between the open position and the shut-off position. It should be noted that the joint pin A may, for example, extend transversally to the direction of movement of the control button 35.

Finally, the control system comprises a switch 39, such as a lever switch or a microswitch, configured to cut the power supply to the blower 25 and to the heating device 26 when the air outlet 31 is closed off by the shut-off member 32, and to control the power supply to the blower 25 and the heating device 26 when the air outlet 31 is at least partially uncovered by the shut-off member 32. According to the embodiment represented by FIGS. 1 to 8, the switch 39 is configured to be actuated by the connecting device, and more particularly by the connecting member 36, when the shut-off member 32 is moved between the shut-off position and the open position.

Advantageously, the steamer head 4 further comprises a gripping section 41 in order to facilitate gripping of the steamer head 4 by a user, and a hanging element 42 arranged on the first protective cover 14 and configured to allow the steamer head 4 to hang on a support.

The steamer head 4 could further comprise an elongated adhering element 43, preferably elastically deformable, extending close to the steam diffusion soleplate 19, and configured to generate friction on a garment to be smoothed, which favors the smoothing of the latter.

A process for smoothing a garment or similar item using the smoothing apparatus 2 will now be described, assuming that initially the shut-off member 32 of the steamer head is in the shut-off position. Such a smoothing process includes the following steps:

- supply electrical power to the base unit 3 so as to generate steam and to supply steam to the steamer head 4,
- move the steam diffusion soleplate 19 on or along a garment or similar item, so as to smooth it,
- move the control button 35 to the operating position, such that the connecting member 36 releases the switch 39 and, for example, stops exerting pressure on the lever of the switch 39, and such that the shut-off member 32 uncovers the air outlet 31,
- supply electrical power to the heating device 26 and to the blower 25 so as to generate a stream of hot air which is diffused by the air outlet 31,
- move the steamer head 4 on or along the garment so as to dry it,
- move the control button 35 to the off position, such that the connecting member 36 actuates the switch 39, and for example exerts pressure on the lever of the switch 39, and such that the shut-off member 32 closes off the steam outlet 31, cut the power supply to the heating device 26 and to the blower 25.

Figure 9:
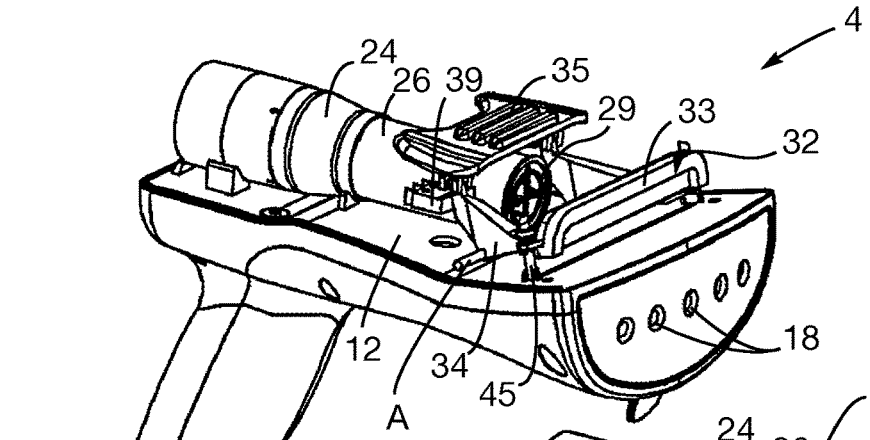
FIGS. 9 and 10 are partial perspective views of a steamer head according to a second embodiment of the invention, showing the shut-off member in the open position and in the shut-off position, respectively.
Figure 10:
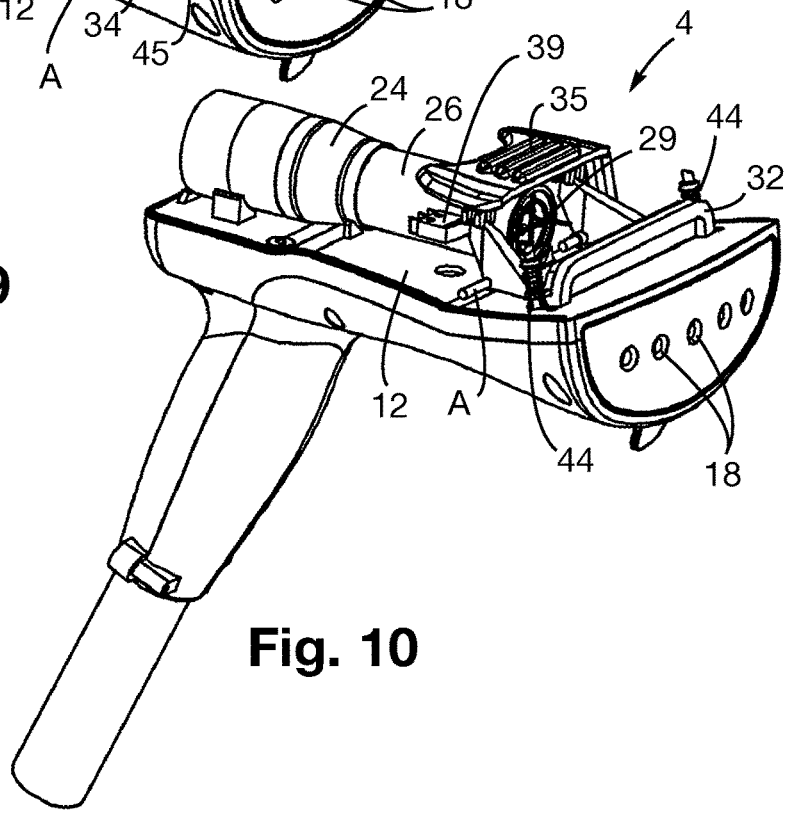
Figure 11:
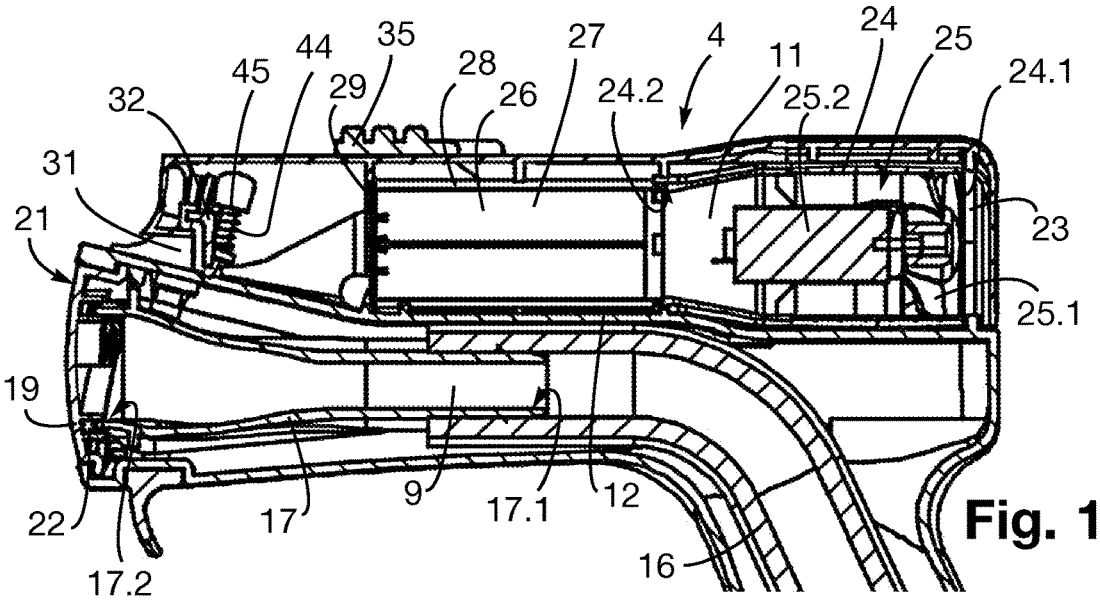
FIG. 11 is a partial longitudinal cross-sectional view of the steamer head in FIG. 8, showing a shut-off member in the shut-off position.

FIGS. 9 to 11 represent a steamer head 4 according to a second embodiment of the invention which differs from the first embodiment essentially in that the control button 35 is directly connected to the shut-off member 32, and in that the switch 39 is configured to be actuated by the shut-off member 32, for example by the actuating part 34, when the shut-off member 32 is moved between the shut-off position and the open position.

According to this second embodiment of the invention, the steamer head 4 comprises two biasing members 44, such as helical springs, configured to bias the shut-off member 32 toward the shut-off position, and two guide elements 45, such as two guide rods, configure to guide the shut-off member 32 when it is moved between the shut-off position and the open position. Each biasing member 44 may, for example, be mounted on a respective guide element 45, and each guide element 45 may, for example, be attached to the body 8 and extend close to a respective end of the shut-off part 33.

According to other embodiments of the invention not represented in the figures, the shut-off member 32 could be mounted such that it can move in translation between the shut-off position and the open position, or could even be a removable plug.

As goes without saying, the invention is not limited only to the forms of execution of the steamer head described above as an example. On the contrary, it encompasses all embodiment variants. Thus, in particular, the control button could be arranged at another location on the body, the connecting device and the heating device could have different structures, the positions of the steam distribution circuit and of the air distribution circuit could be reversed.

The invention claimed is:

1. A steamer head comprising:

a body enclosing a steam distribution circuit and an air distribution circuit separated from one another, the steam distribution circuit comprising at least one steam inlet orifice configured to be connected to a steam generator and at least one steam outlet for diffusing a stream of steam, the air distribution circuit comprising a blower, an air inlet orifice and an air outlet for diffusing a stream of air, the at least one steam outlet and the air outlet arranged at a same end of the body of the steamer head, and a control system configured to cut the power supply to the blower when the air outlet is closed off by the shut-off member, wherein the steamer head comprises a shut-off member configured to be moved between a shut-off position in which the shut-off member closes off the air outlet and an open position in which the shut-off member uncovers the air outlet.

2. The steamer head according to claim 1, wherein the shut-off member is configured to close off the air outlet in a steam-proof manner when the shut-off member is in the shut-off position.

3. The steamer head according to claim 1, wherein the control system comprises a switch that can be actuated by a movement of the shut-off member, the switch being configured to cut the power supply to the blower when the air outlet is closed off by the shut-off member.

4. The steamer head according to claim 1, wherein the control system comprises a control button mounted such that the control button is moveable on the body of the steamer head between an operating position and an off position, and the steamer head being configured such that a movement of the control button from the operating position to the off position causes the shut-off member to move from the open position to the shut-off position, and such that a movement of the control button from the off position to the operating position causes the shut-off member to move from the shut-off position to the open position.

5. The steamer head according to claim 1, wherein the air distribution circuit comprises a heating device configured to heat the stream of air.

6. The steamer head according to claim 1, wherein the air inlet orifice and the air outlet are arranged at two opposite ends of the body of the steamer head.

7. The steamer head according to claim 1, wherein the shut-off member is mounted such that the shut-off member is pivotable between the shut-off position and the open position.

8. The steamer head according to claim 1, wherein the shut-off member is mounted such that the shut-off member is moveable in translation between the shut-off position and the open position.

9. The steamer head according to claim 1, wherein the shut-off member is a removable plug.

10. The steamer head according to claim 1, wherein the body comprises a dividing partition separating the steam distribution circuit and the air distribution circuit from one another.

11. A steam smoothing apparatus comprising a base unit provided with a steam generator and a steamer head according to claim 1.

12. A steamer head comprising:

a body enclosing a steam distribution circuit and an air distribution circuit separated from one another, the steam distribution circuit comprising at least one steam inlet orifice configured to be connected to a steam generator and at least one steam outlet for diffusing a stream of steam, the air distribution circuit comprising a blower, an air inlet orifice and an air outlet for diffusing a stream of air, the at least one steam outlet and the air outlet arranged at a same end of the body of the steamer head, and a control system configured to cut the power supply to the blower when the air outlet is closed off by the shut-off member, wherein the control system is configured to cut the power supply to the heating device when the air outlet is closed off by the shut-off member, wherein the air distribution circuit comprises a heating device configured to heat the stream of air, and wherein the steamer head comprises a shut-off member configured to be moved between a shut-off position in which the shut-off member closes off the air outlet and an open position in which the shut-off member uncovers the air outlet.

13. The steamer head according to claim 12, wherein the shut-off member is configured to close off the air outlet in a steam-proof manner when the shut-off member is in the shut-off position.

14. The steamer head according to claim 12, wherein the air inlet orifice and the air outlet are arranged at two opposite ends of the body of the steamer head.

15. The steamer head according to claim 12, wherein the shut-off member is mounted such that the shut-off member is pivotable between the shut-off position and the open position.

16. The steamer head according to claim 12, wherein the shut-off member is mounted such that the shut-off member is moveable in translation between the shut-off position and the open position.

17. The steamer head according to claim 12, wherein the shut-off member is a removable plug.

18. The steamer head according to claim 12, wherein the body comprises a dividing partition separating the steam distribution circuit and the air distribution circuit from one another.

19. A steam smoothing apparatus comprising a base unit provided with a steam generator and a steamer head according to claim 12.

* * * * *